US009346177B2

(12) United States Patent
Mayes

(10) Patent No.: US 9,346,177 B2
(45) Date of Patent: May 24, 2016

(54) DIVER'S KNIFE AND CUTTING TOOL

(75) Inventor: Laura Jane Mayes, Valley Village, CA (US)

(73) Assignee: EEZYCUT, Valley Village, CA (US)

( * ) Notice: Subject to any disclaimer, the term of this patent is extended or adjusted under 35 U.S.C. 154(b) by 884 days.

(21) Appl. No.: 12/806,927

(22) Filed: Aug. 23, 2010

(65) Prior Publication Data

US 2011/0061503 A1 Mar. 17, 2011

Related U.S. Application Data

(63) Continuation-in-part of application No. PCT/US2010/002293, filed on Aug. 20, 2010.

(60) Provisional application No. 61/236,084, filed on Aug. 22, 2009.

(51) Int. Cl.

| | |
|---|---|
| ***B26B 5/00*** | (2006.01) |
| ***B26B 9/02*** | (2006.01) |
| ***B63C 11/52*** | (2006.01) |

(52) U.S. Cl.

CPC ... *B26B 5/00* (2013.01); *B26B 9/02* (2013.01); *B63C 11/52* (2013.01); *Y10T 83/04* (2015.04)

(58) Field of Classification Search

CPC ..... B26B 3/00; B26B 3/08; B26B 5/00; B26B 9/00; B26B 9/02; B26B 29/00; B26B 29/02; B26B 29/06; B63C 11/52; Y10T 83/04

USPC ..... 30/162, 280, 286–291; 411/90, 119

See application file for complete search history.

(56) References Cited

U.S. PATENT DOCUMENTS

| | | | | |
|---|---|---|---|---|
| 1,553,449 | A * | 9/1925 | Kennedy | 30/294 |
| 2,471,334 | A * | 5/1949 | Levin | 30/287 |
| 2,593,601 | A * | 4/1952 | Pollak | 30/2 |
| 3,613,241 | A | 10/1971 | Allen | |
| 4,620,369 | A * | 11/1986 | Gercken | 30/329 |
| 5,046,253 | A | 9/1991 | Ireland | |
| D362,168 | S * | 9/1995 | Mancini | D8/98 |
| 6,691,416 | B2 * | 2/2004 | Yu Chen | 30/294 |
| 7,624,507 | B2 * | 12/2009 | Bergstrand | 30/294 |
| 2004/0158992 | A1 * | 8/2004 | Huang | 30/162 |
| 2007/0101592 | A1 * | 5/2007 | Wen | 30/517 |
| 2008/0040932 | A1 * | 2/2008 | Gullicks et al. | 30/294 |
| 2010/0293796 | A1 * | 11/2010 | Votolato | 30/287 |

FOREIGN PATENT DOCUMENTS

| | | | |
|---|---|---|---|
| GB | 508438 | A | 6/1939 |
| GB | 896559 | A | 5/1962 |
| GB | 2330323 | A | 4/1999 |

* cited by examiner

*Primary Examiner* — Phong Nguyen

(74) *Attorney, Agent, or Firm* — Bowen Liu; Jay White; David Lewis

(57) ABSTRACT

A diver's knife that includes a casing with a bottom portion, a top half and a bottom half, a handle slot disposed on bottom portion of casing to allow a user to grasp diver's knife, a single-sided cutting blade to cut a line with a cutting edge with a top end and a blade aperture, with the single-sided cutting blade being sandwiched between top half and bottom half of casing. The diver's knife also includes a slot disposed on a side of casing to receive a line to be cut by an exposed single-sided cutting blade with cutting edge and an fastener to secure top half of casing, single-sided cutting blade and bottom half of casing together to form diver's knife. The diver's knife can also be double-sided to cut the line from both sides.

16 Claims, 19 Drawing Sheets

DIVER'S KNIFE AND CUTTING TOOL

CROSS-REFERENCE TO RELATED APPLICATIONS

This application is a continuation-in-part of Patent Cooperation Treaty Application Serial Number PCT/US10/02293, filed Aug. 20, 2010, by Laura Mayes, which in turn claims priority benefit of U.S. Provisional Patent Application No. 61/236,084, entitled "Fishbone Blade Cutting Tool", filed Aug. 22, 2009, by Laura Mayes; this application also claims priority benefit of U.S. Provisional Patent Application No. 61/236,084, entitled "Fishbone Blade Cutting Tool", filed Aug. 22, 2009, by Laura Mayes. Both of the above applications, Patent Cooperation Treaty Application Serial Number PCT/US10/02293 , filed Aug. 20, 2010, by Laura Mayes and U.S. Provisional Patent Application No. 61/236,084, entitled "Fishbone Blade Cutting Tool", filed Aug. 22, 2009, by Laura Mayes, are incorporated herein by reference.

FIELD

This specification generally relates to a cutting tool for cutting line, webbing, and/or string.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Divers such as underwater divers and sky divers need reliable tools in order to safely dive.

SUMMARY

In one embodiment, a relatively small cutting tool may be provided to be used by open water and overhead environment divers, surfers, firemen, rescue workers, as well as sky divers, para-gliders, fishermen, marine services personnel, arts and crafts operatives and for a normal household toolkit to be used by anyone who needs to cut rope, line, and or string. At different places in the specification different lists of users and uses appear. Any of the embodiments in this specification may be used by any of the users and for any of the uses suggested by any of these lists, no matter where in the specification the list of users and uses appears. In this specification the word line is generic to cord, rope, string, packaging, and wires. In an embodiment, the knife includes an overhang and/or a directing edge that is located on the overhang opposite the blade and may have a convex shape that bulges inwards towards the knife blade directing the line towards the blade as the knife is pulled in a direction parallel to the edge of the blade. In an embodiment, the overhang includes a groove that is opposite the blade, which will tend to pinch, fold, or press the line as the knife is pulled in a direction parallel to the edge of the blade.

Any of the above embodiments may be used alone or together with one another in any combination. Inventions encompassed within this specification may also include embodiments that are only partially mentioned or alluded to or are not mentioned or alluded to at all in this brief summary or in the abstract.

BRIEF DESCRIPTION OF THE FIGURES

In the following drawings like reference numbers are used to refer to like elements. Although the following figures depict various examples of the invention, the invention is not limited to the examples depicted in the figures.

DETAILED DESCRIPTION

Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification and some embodiments may not address any of these deficiencies.

Single Sided Knife

Figure 1A:
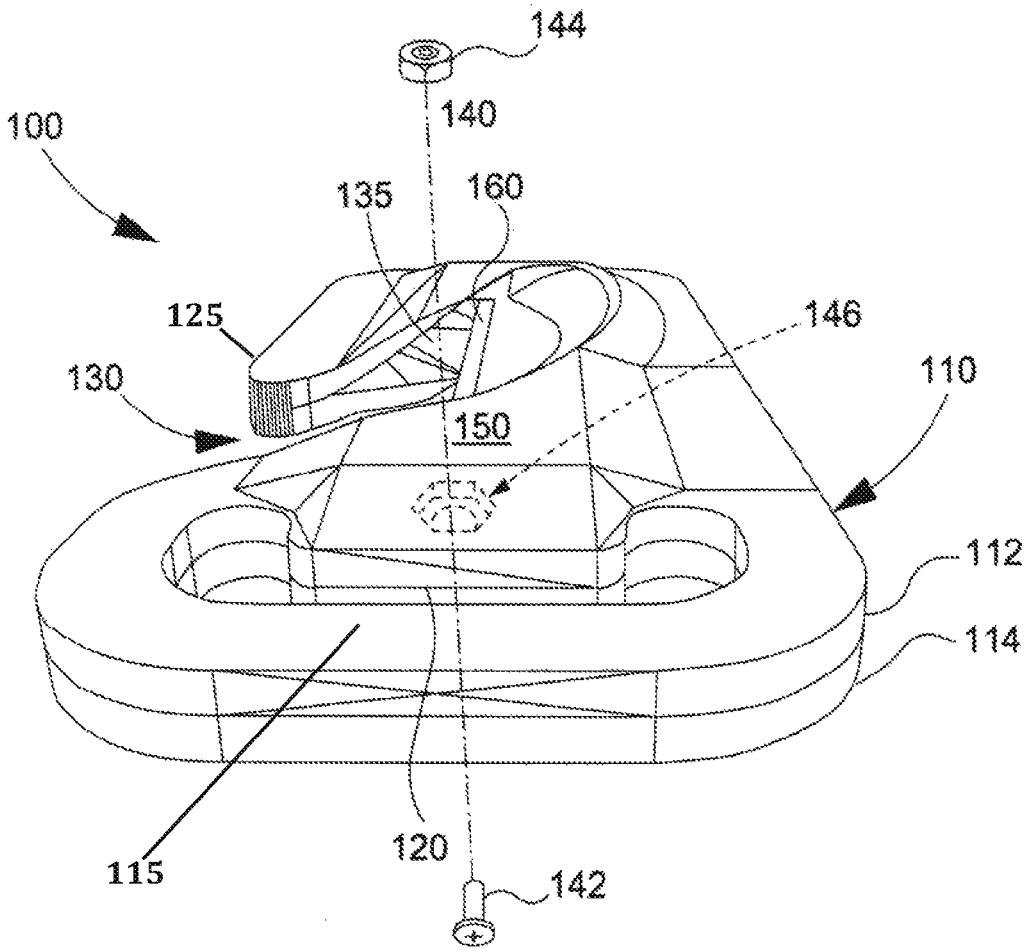
FIG. 1A shows an overhead front perspective view of an embodiment of a single-side knife.

FIG. 1A shows an example of a top front perspective view of an embodiment of a knife 100. Knife 100 includes a casing 110. Casing 110 includes a top half 112 and a bottom half 114.

Knife 100 also includes a handle 115 having handle slot 120, arm 125 forming slot 130, groove 135, a fastener 140 having a screw 142 with a nut 144, socket 146, an optional cover 150, and a blade 160. Other embodiments of single-side knife 100 may not have all of the components and/or may have other embodiments in addition to or instead of the components listed above.

Knife 100 is single sided, having only one blade on only one side of knife 100 that is exposed. Top half 112 and bottom half 114 are sandwiched together and secured in place by a fastener, such as screw, bolt, rivet, clasp of other fastener. Casing 110 may be made of any plastic polymeric material. In alternative embodiments, casing 110 may be made of other materials, such as other plastics, wood, metals, or ceramics. Any place is the specification where plastic is mentioned, Kevlar® wood, ceramic, or another material may be substituted. Arm 125 overhangs the blade, directs the line into the blade, and helps protect a user from inadvertently cutting themselves or the wrong line with the blade. Handle slot 120 is located at the bottom of casing 110 for a user to grasp knife 100. Handle slot 120 is also designed to receive an attachment strap (not shown) to attach knife 100 to a user. Arm 125 is an overhang that protects the user from the blade. Slot 130 is provided on only one side of casing 110 and receives any line that is to be cut. Slot 130 and additional features are described in FIG. 1B and FIG. 1C. Optionally, slot 130 may be shaped to act as a bottle opener. Groove 135 is opposite the cutting blade, and shields the cutting blade from accidently coming in contact with objects and part of the body. Groove 135 is a hollowed out portion of arm 125 or the overhang. Line being cut will tend to pinch, fold, or press as a result of the cutting blade pushing the line into the groove 135. Fastener 140 holds top half 112 of casing 110 and bottom half 114 of casing 110 together. In an embodiment, screw 142 and nut 144 are made from 316ss grade stainless steel, or another corrosion resistant alloy that can withstand prolonged exposure to salt and water without corroding. In an embodiment nut 144 is hexagonally shaped. In an alternative embodiment, screw 142 has a hexagonal shaped head. However, in another embodiment screw 142 and/or nut 144 can be made of another material, such as a strong and durable plastic or another grade of metal. Socket 146 is noncircular and mates with nut 144, so that screw 142 may be screwed into nut 144 while socket 146 prevents nut 144 from turning. Optional cover 150 is placed over fastener 140 to cover and protect fastener 140. Socket 146 is drawn in phantom, because socket 146 is hidden from view by optional cover 150. Once nut 144 is placed in socket 146, optional cover 150 (if present) hides nut 144 from view. There may be a similar cover covering each of the socket for screws and nuts of each the embodiments of the knives in this specification. Blade 160 is held between top cover 112 and bottom cover 114 and secured in place by fastener 140 just off the edge of slot 130. Blade 160 is exposed to cut the line. In an embodiment, blade 160 is replaceable and is made of passivated 440a stainless steel with a silicone coating for marine use and ordinary carbon steel for non-marine use. In an embodiment, blade 160 may be a razor blade.

Figure 1B:
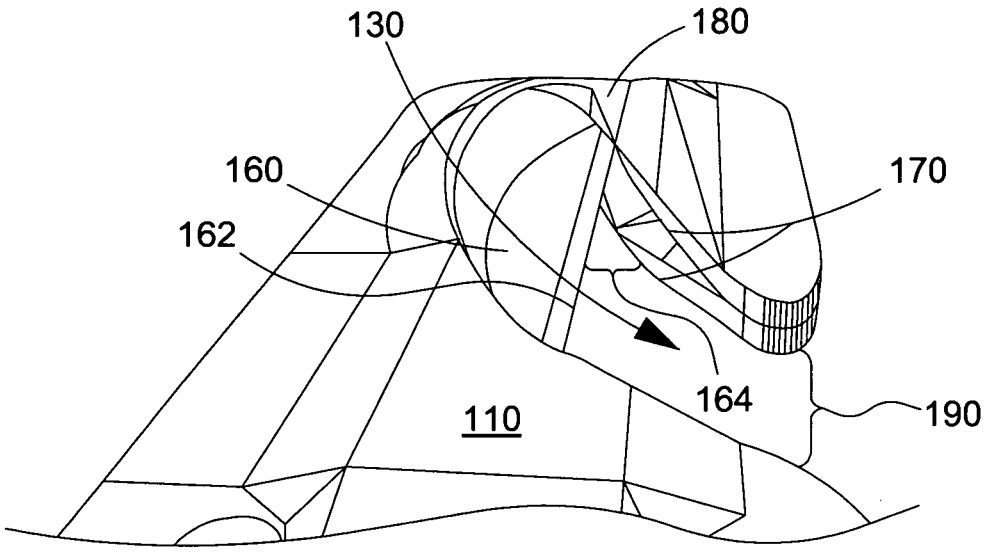
FIG. 1B shows a partial overhead front perspective view of an embodiment of a slot of a single-side knife.

FIG. 1B shows a front overhead perspective view of an embodiment of a slot 130 of the knife 100. Slot 130 includes a cutting edge 162 (of the blade 160), a distance 164 to a directing edge 170, an overhang 180 of arm 125, and an opening 190 to the blade. Other embodiments of slot 130 may not have all of the components and/or may have other embodiments in addition to or instead of the components listed above.

Cutting edge 162 of the blade 160 cuts line that is run or drawn along directing edge 170, which pushes the line against cutting edge 162 (of the blade 160). Distance 164 between the convex edge and the blade is relatively small and helps prevent a user from cutting their fingers on blade 160. Distance 164 decreases in the direction moving towards one end of the blade 160. Directing edge 170 is angled with respect to cutting edge 162 so as to force or push the line or rope onto cutting edge 162 of the blade 160 as distance 164 decreases, which facilitates cutting the line. The cutting action is relatively cleaner, more precise, and easier to cut as a result of the directing edge 170 pushing the line onto cutting edge 162. Overhang 180, which is the portion of arm 125 that overhangs blade 162, is disposed over an end of cutting edge 162 of the blade 160 to help prevent the user from cutting their finger while using knife 100. Opening 190 is disposed along side of casing 110 and is also relatively small to help prevent the user from cutting their finger while using knife 100. Opening 190 also receives any line or string to be run and cut along cutting edge 162 of the blade 160 by knife 100. Although in the current embodiment, opening 190 is in the middle of knife 100, in other embodiments, opening 190 may be at the front of knife 100.

Figure 1C:
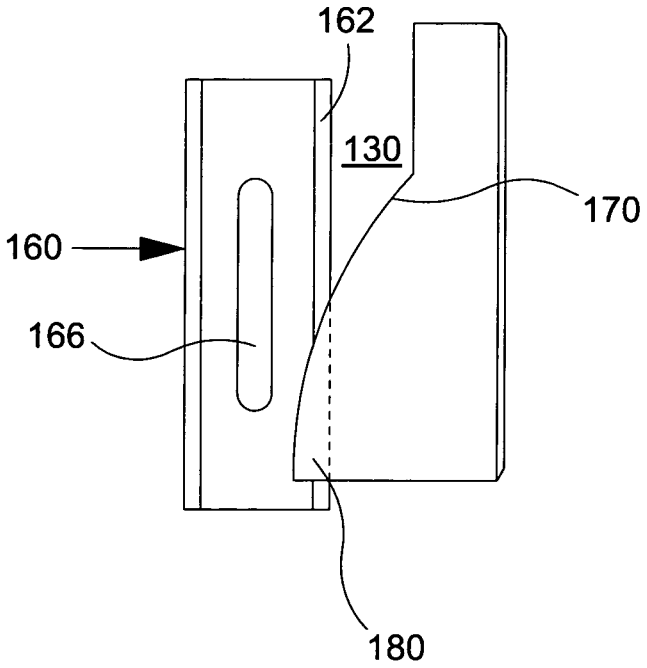
FIG. 1C shows a side perspective view of an embodiment of a cutting blade and a directing edge of a single-sided knife.

FIG. 1C shows a representation of an embodiment of a blade 160 and a directing edge 170 of knife 100. Blade 160 and directing edge 170 include cutting edge 162 of the blade 160, a blade aperture 166, and overhang 180. Other embodiments of blade 160 and a directing edge 170 of knife 100 may not have all of the components and/or may have other embodiments in addition to or instead of the components listed above.

FIG. 1C shows the relative orientation of blade 160 with respect to directing edge 170. As knife 100 is pulled, the line will run along directing edge 170 and be pushed onto cutting edge 162 for a relatively cleaner, more precise and stronger cut, as described in FIG. 1B. Overhang 180 is disposed over an end of cutting edge 162 of the blade 160 to help prevent user from cutting their finger while using single-side knife 100 and to guide the rope or line onto blade 160, as described in FIG. 1B. Blade aperture 166 is placed on one or more posts that protrude through and hold blade 160 in place when knife 100 is assembled. In an embodiment, screw 142 passes through aperture 166 (either passing directly through aperture 166 or passing through aperture 166, while blade 160 is set between top cover 112 and bottom cover 114 of the casing to secure blade 160 in a fixed position, which, in an embodiment, is away from center of casing 110 towards inner grove 130.

Figure 1D:
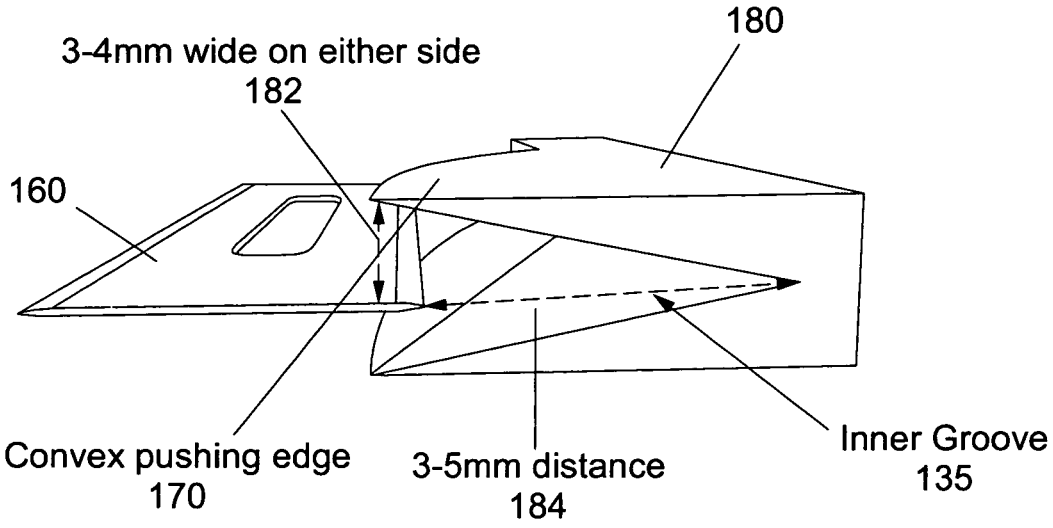
FIG. 1D shows the location of the blade with respect to the overhang.

FIG. 1D shows the location of the blade with respect to the overhang. FIG. 1D shows groove 135, blade 160, directing edge 170, overhang 180, distance 182, and distance 184. In other embodiments, the view illustrated in FIG. 1D may not have all of the features and/or may have other embodiments in addition to or instead of the features listed above.

Groove 135 was discussed in conjunction with FIG. 1A. Blade 160 and overhang 180 were discussed above in conjunction with FIGS. 1A-C. Distance 182 is the distance from the top flat surface of blade 160 to the top of the face of knife 100, which may be 3to 4 mm, for example Distance 184 is the distance from the cutting edge of blade 160 to the apex of groove 135 (which may also be referred to as the inner groove).

Double Sided Knife

Figure 2A:
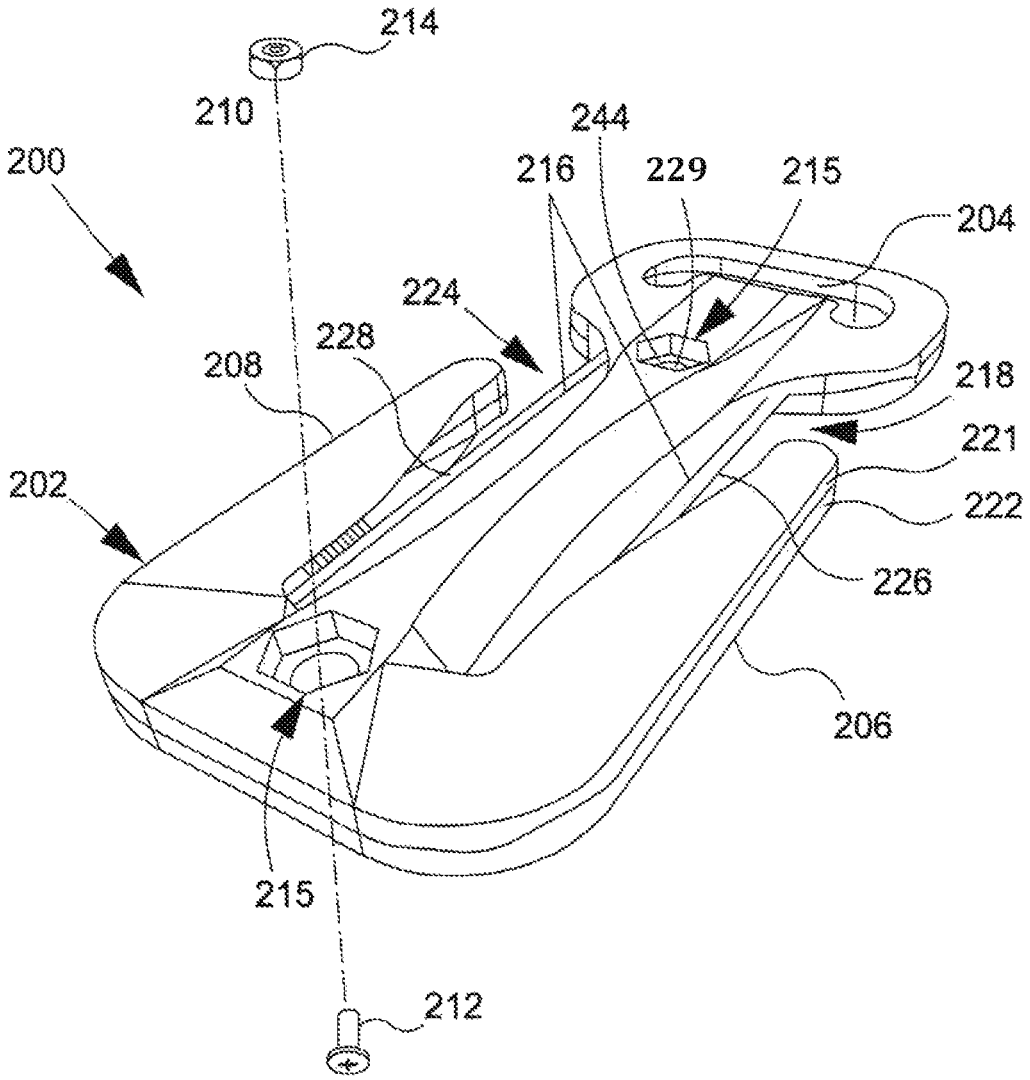
FIG. 2A shows a side overhead perspective view of an embodiment of a double-sided knife.

FIG. 2A shows a side overhead perspective view of an embodiment of a knife 200. Knife 200 includes a casing 202, a handle slot 204, side 206, side 208, fastener 210 having screws 212 with nuts 214, a blade 216, first slot 218, bottom half 221, top half 222, second slot 224, first cutting blade 226, second cutting blade 228, and hole 229. Other embodiments of knife 200 may not have all of the components and/or may have other embodiments in addition to or instead of the components listed above. nt, the knife 200 is a relatively small cutting tool used by open water and overhead environment divers, surfers, as well as sky divers, para-gliders, fishermen, marine services personnel, rock climbers, fire and rescue, kite surfers on the water, arts and crafts operatives and in a normal household toolkit by anyone who needs to cut the line.

The knife 200 has two exposed edges on either side available for cutting. The knife 200 is double-sided, so it can be used to cut from either side, which can be useful in an emergency. Knife 200 is essentially the same as knife 100 except that knife 200 has two blades exposed, and each blade has its own overhang and surface for pushing the line into the corresponding blade as knife 200 is pulled, whereas in contrast knife 100 only has one blade exposed. In general any feature of knife 100 may be incorporated in knife 200 and any feature of knife 200 may be incorporated in knife 100. Similarly, for any embodiment of knife 100 there is a corresponding embodiment of knife 200 and for any embodiment of knife 200 there is a corresponding embodiment of knife 100.

The description of casing 110, top half 112, bottom half 114, handle slot 120, slot 130, fastener 140, screw 142, nut 144, socket 146, blade 160, and cutting edge 162 have essentially the same description as casing 202, top half 221, bottom half 222, a handle 204, first slot 218, second slot 224, fasteners 210, screws 212, nuts 214, socket 215, first cutting blade 226, and second cutting blade 228, respectively, except that there is only one slot 130 that corresponds to blade 216, both first slot 230 and second slot 235. Also there is only one fastener 140 that corresponds to two fasteners 210, one screw 142 that corresponds to two screws 212, and one nut 144 that corresponds to two nuts 214, and one socket 146 corresponds to two sockets 215.

Casing 202 has a top cover and a bottom cover that are attached together, via fasteners. In an embodiment, casing 202 is made of any plastic polymeric material, wood, or Kevlar® other material. Handle slot 204 is located at the bottom of casing 202 for a user to grasp knife 200. Handle slot 204 is designed to receive an attachment strap (not shown) to attach knife 200 to a user. Sides 206 and 208 are two different sides of knife 200, both of which may be used for cutting the line. Sides 206 and 208 are also the sides of arms or overhangs that overhang the cutting edges of the blade protecting against accidentally cutting an object.

Screws 212 and nuts 214 hold casing 202 together. First slot 230 and second slot 235 can receive any line that is to be cut. Fastener 210 may include a plurality of 316ss grade stainless steel screws 212 with nuts 214, which may both be made of a corrosion resistant alloy that withstands exposure to salt and water. However fastener 210 can be any grade of metal.

Blade 216 is double-sided. Blade 216 is replaceable and is made of passivated 440a stainless steel with a silicone coating for marine use and ordinary carbon steel for non-marine use. First slot 218 will be discussed below in conjunction with second slot 224.

Top cover 221 is the top half of casing 202, and bottom cover 222 is the bottom half of casing 202. Top cover 221 and Bottom cover 222 detach form one another by removing the screws 212 and 214. Blade 216 is held between top cover 221 and bottom cover 222 of the casing and secured in place by fastener 210.

First slot 218 is provided on one side 206 of the casing and second slot 224 is provided on side 208 (the other side) of the casing. Blade 216 is exposed within first slot 218 and second slot 224 for cutting the line as desired by user. Additional features of first slot 218 and second slot 224 are described in FIG. 2B and FIG. 2C. Hole 229 allows screw 212 to pass through to secure to nut 214.

The knives 100 and 200 can be used by divers and other users of line cutting tools and is relatively small, double-sided, does not have a large open blade (which is a safety feature) and can cut the line up to 14 mm (0.55 inches) wide, can cut the line from either side and can be reused by throwing away the old blade and replacing it with a standard sized new carpet blade after the blade wears out. In other embodiments, wider lines can be cut by using a larger version of the knives 100 and 200. Since the blade 160 or 216 is not exposed, the likelihood of cutting oneself or cutting something unintentionally is reduced.

Figure 2B:
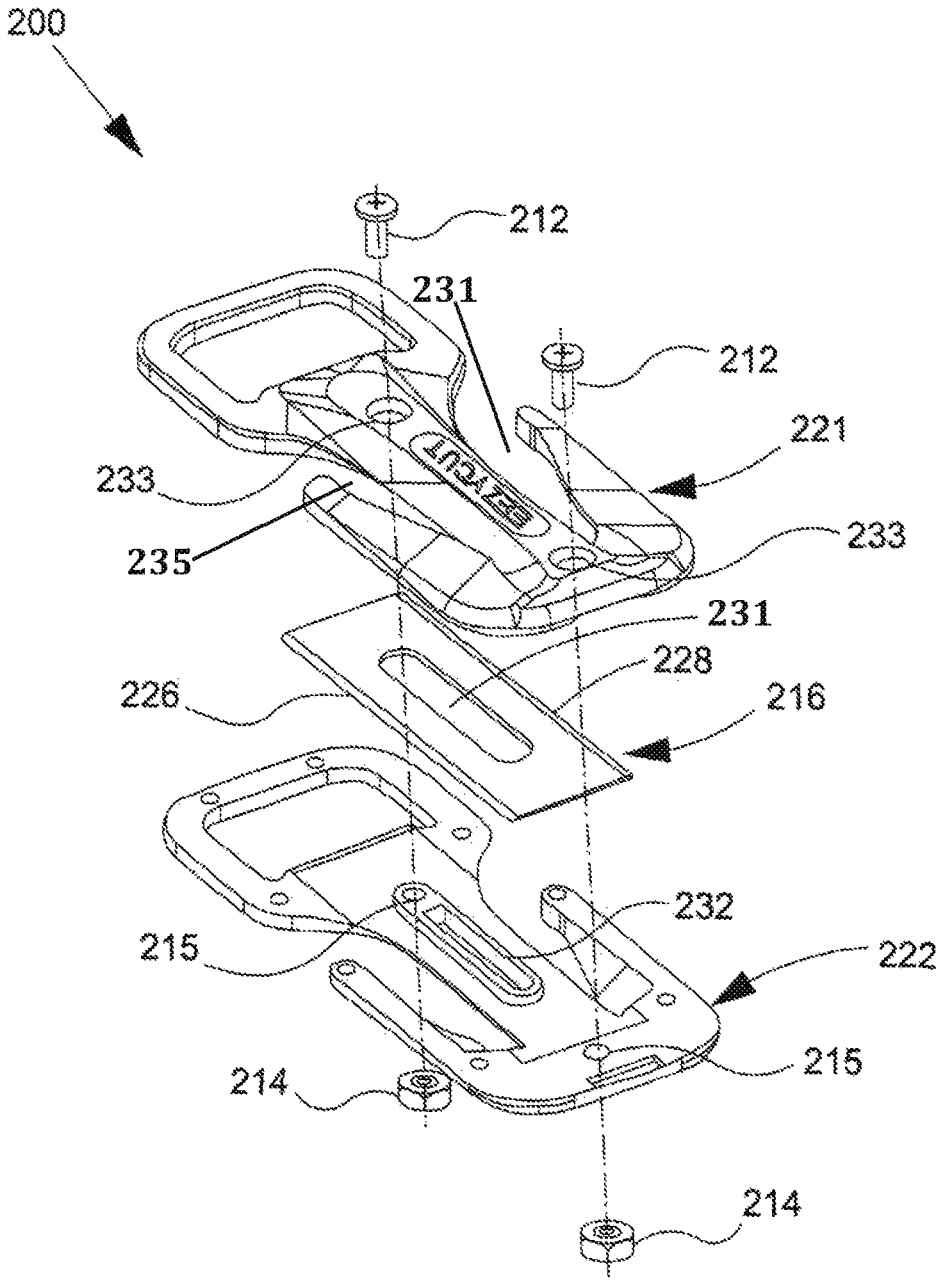
FIG. 2B shows an exploded, side, overhead, perspective view of an embodiment of a double-sided knife.

FIG. 2B shows an exploded side overhead perspective view of an embodiment of a knife 200. Knife 200 includes top half 221 of the casing, bottom half 222 of the casing, screws 212, nuts 214, sockets 215, blade 216, a first cutting edge 226, a second cutting edge 228, hole 229, a slotted aperture 231, and a raised fitting 232 for the slotted aperture, and socket 233. Other embodiments of double-sides knife 200 may not have all of the components and/or may have other embodiments in addition to or instead of the components listed above.

Top half 221 of the casing, bottom half 222 of the casing, screws 212, nuts 214, socket 215, blade 216, first cutting edge 226, second cutting edge 228 and a slotted and aperture 231 have essentially the same description as top half 112, bottom half 114, screw 142, nut 144, socket 146, blade 160, cutting edge 162, aperture 166, which were described above in conjunction with FIGS. 1A-1C. However, although there is only one of each of screw 142, nut 144, and cutting edge 162, there are two of each of screws 212 and nuts 214, socket 215, and the first cutting edge 226 and the second cutting edge 228 correspond to cutting edge 162.

Top cover 221 of the casing and bottom cover 222 of casing are set between blade 216 to form casing 202. Top cover 221 of casing and bottom cover 222 of casing also have sockets 215 to accommodate screws 212 that are extended through screw apertures 242 (FIG. 2A). Nuts 214 are placed on ends of screws 212 to secure screws 212, top cover 221 of the casing, bottom cover 222 of the casing and blade 216 together. First cutting edge 226 is exposed in first slot 230 on one side of knife 200 to cut the line. Second cutting edge 228 is exposed in second slot 235 on other side of the diver's knife to cut the line. Slotted aperture 231 is provided to accommodate screw 212 if necessary. Raised fitting 232 is provided to accommodate slotted aperture 231 and hold blade 216 in place. Sockets 233 receive screws 212. The heads of screws 212 rest in sockets 233. Raised fitting 232 is a protrusion sitting within a rectangular shaped well or depression. Blade 216 sits in the well or depression, while aperture 231 mates with raised fitting 232.

Figure 2E:
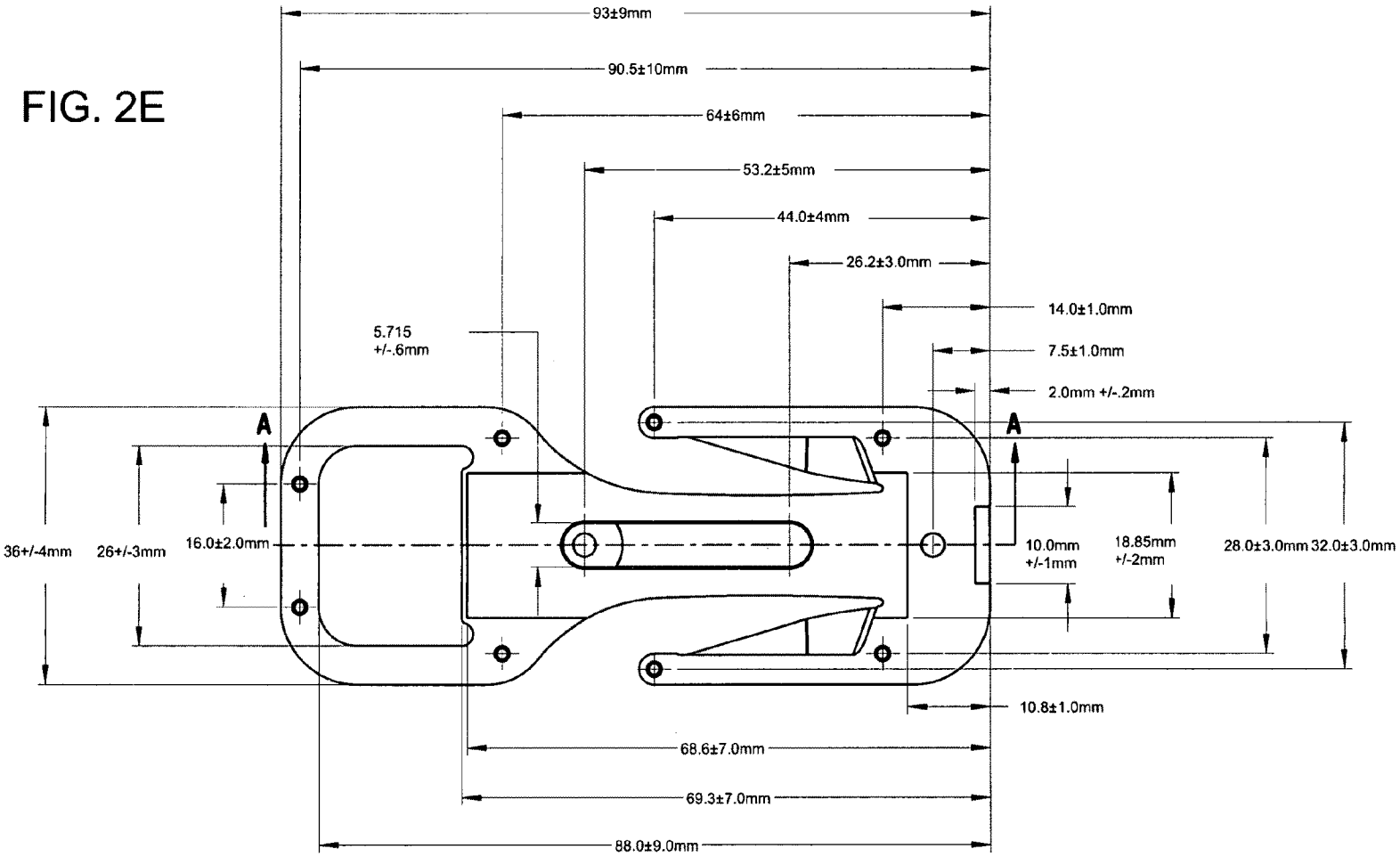
FIG. 2E shows the inner surface of the top half of the casing of FIG. 2D, and the dimension of an embodiment of the knife.
Figure 2F:
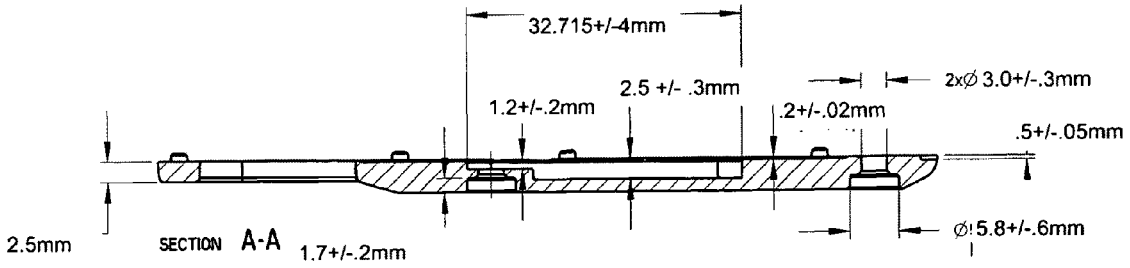
FIG. 2F shows a cross section of the bottom half of the casing of FIG. 2D, and the dimension of an embodiment of the knife.
Figure 2C:
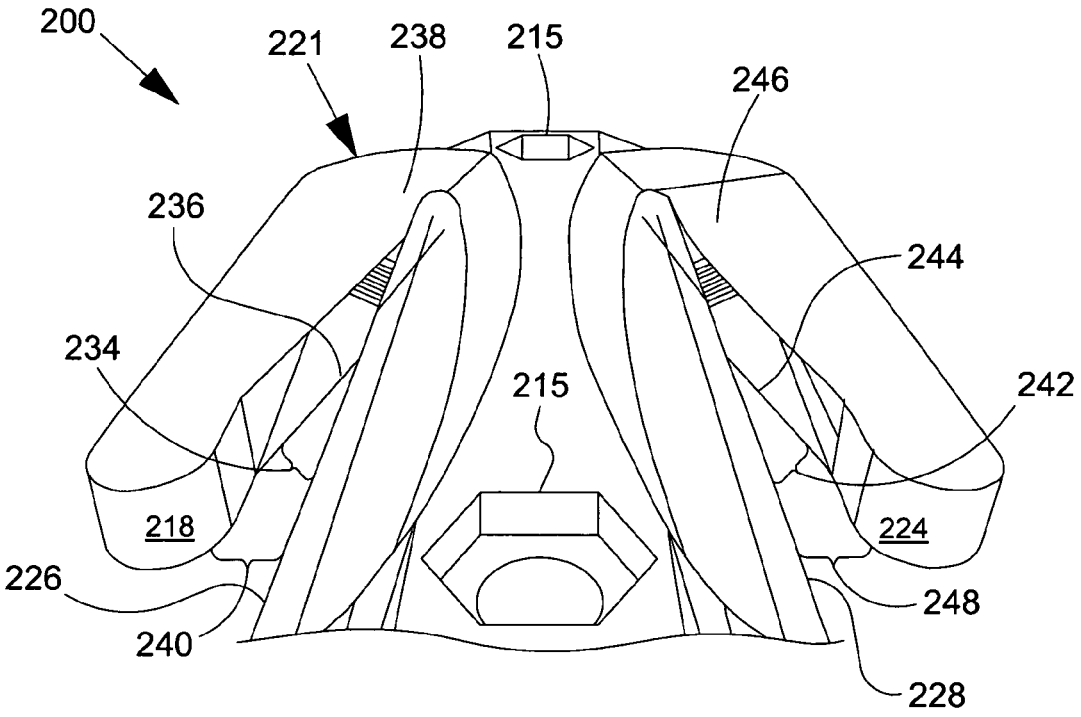
FIG. 2C shows an overhead front perspective view of an embodiment of slots of a double-sided knife.

FIG. 2C shows an overhead perspective view of an embodiment of first slot 218 and second slot 224 of the knife 200. Knife 200 includes first slot 218, second slot 224, first cutting edge 226, second cutting edge 228, a first distance 234, a first directing edge 236, a first overhang 238 of the first convex edge and a first opening 240 to the cutting blade, a second distance 242 between the second directing edge and the second cutting blade, a second directing edge 244, a second overhang 246 of the second directing edge and a second opening 248. Other embodiments of first slot 218 and second slot 224 of the knife 200 may not have all of the components and/or may have other embodiments in addition to or instead of the components listed above.

First slot 218 and second slot 224 correspond to slot 130, first cutting edge 226 and second cutting edge 228 correspond to cutting edge 162, first distance 234 and second distance 242 correspond to distance 164, first directing edge 236 correspond to directing edge 170, a first overhang 238 and second overhang 246 correspond to overhang 180, of the first convex edge 236 and a first opening 240 to the cutting blade, a second distance 242 between the second directing edge 244 and the second cutting blade, a second directing edge 244, a second overhang 246 of the second directing edge and a second opening 248. Slot 130 includes a cutting edge 162 of the blade 160, a distance 164 between the convex edge and the blade 160, a directing edge 170, an overhang 180 of the directing edge and an opening 190 to the blade 160.

Figure 2D:
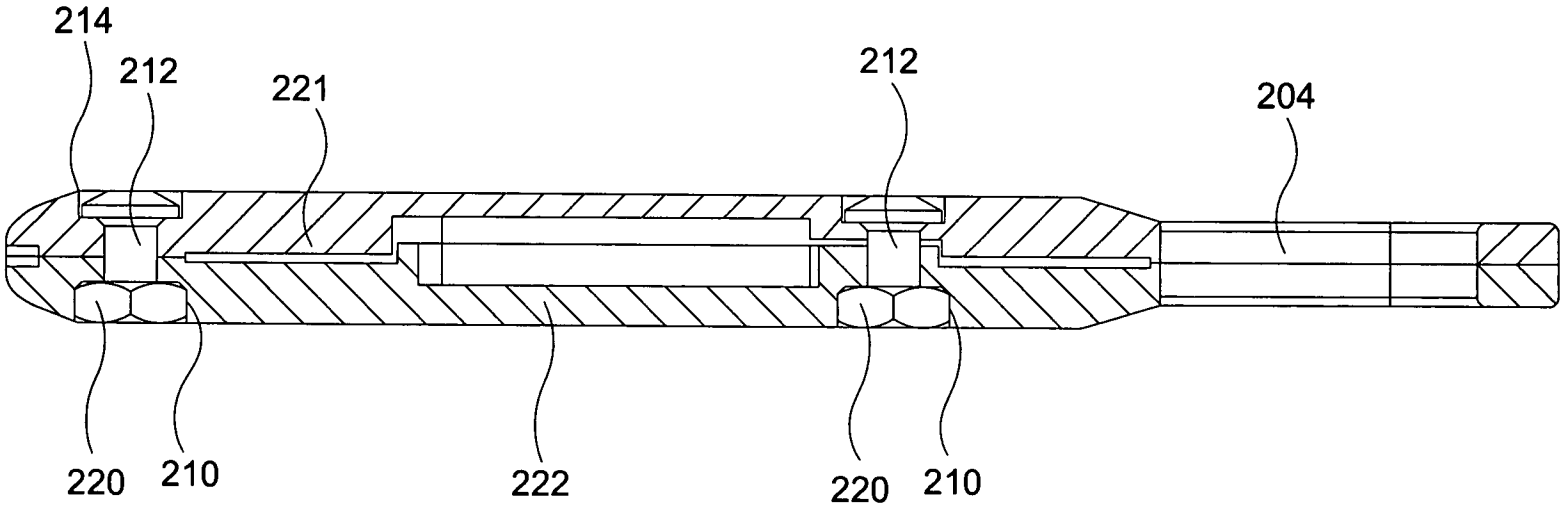
FIG. 2D shows a cross-sectional side perspective view along line 2D-2D from FIG. 2A of a double-sided knife.

FIG. 2D shows a cross-sectional side perspective view along line 2D-2D from FIG. 2A of knife 200. Knife 200 includes casing 202, handle slot 204, fastener 210, screws 212, screw sockets 214, top half 221 and bottom half 222. Other embodiments of knife 200 may not have all of the components and/or may have other embodiments in addition to or instead of the components listed above.

Casing 202, handle slot 204, fastener 210, screws 212 and nuts 214 details are described in FIG. 2A description. Screw sockets 214 receive screws 212 and allow nuts 214 to secure screws 212 with screw sockets 214. Top half 221 and bottom half 222 details are described in FIG. 2B. Additional screw socket 214 is also provided adjacent to slotted aperture 231.

FIG. 2E shows the inner surface of the top half of the casing of FIG. 2D, and the dimension of an embodiment of the knife. FIG. 2F shows a cross section of the bottom half of the casing of FIG. 2D, and the dimension of an embodiment of the knife. The dimension of the top half and bottom half of the knife are similar to one another. In FIGS. 2E and 2F, each dimension is followed by a "+/−" and a value. The value following the +/−, when added and subtracted to the value of the dimension, indicates a range of different embodiments of that dimension for knife 200. FIGS. 2E and 2F are only examples of embodiments of the top and bottom halves of the casing. The specific dimension given in the specification are only examples. Other combinations of dimensions of the top and bottom halves of the casing may also be used. In general the dimension within this specification may be varied within 5%, 10%, or 50% of those given to obtain other embodiments, and in yet more embodiments, the sizes may be varied by even greater amounts to obtain other embodiments. However, the larger the opening to the blade, the less effective the overhang will be in protecting against accidentally cutting an object.

More Discussion about the Single and Double Sided Knife and Dimensions

In an embodiment, the knives 100 and 200 is stored on a user's wrist, making it easy to access, minimizing the amount of time a user might waste (for example, when diving under water time can be precious, because the amount of time that the diver can stay under water may be limited by the amount of air in the air tanks). The knife 100 or 200 can also cut through webbing if the user replaces the blades occasionally with recommended quality carpet blades or the 440A stainless steel. The blade 160 or 216, for marine grade purposes, is a passivated 440a stainless steel blade with a silicone coating. A standard carbon steel blade is recommended for normal non-marine use. The knife 100 or 200 works by either drawing or pulling the knife 100 or 200 against a line or string, making sure the line or string is in the slot of the knife 100 or 200, to produce a cut on the line or string.

In an embodiment, the blade 160 or 216 is a carpet blade that is held in a slot of the knife 100 or 200, used for cutting line, cord or string. The slot 130, 230, and/or 235, which houses the blade 160 or 216, also acts as part of the mechanism that cuts the line or string. The slot 130, 230, and/or 235 has a plastic overhang 180 designed to overhang and cover the blade 160 from both sides, when looked at from an overhead position, by a margin of 3 mm+/−0.3 mm (0.118+/−0.02 inches) and 3.5+/−0.4 mm (0.138+/−0.02 inches), although in other embodiment, the margin could be bigger or smaller. The slot 130, 230, or 235 is designed to expose the blade 160 or 216 from both sides when looked at from an overhead position. In an embodiment, the curve on the directing edge 170, 236 or 244 is convex to the cutting blade and not concave. The directing edge 170, 236, or 244 enhances the cutting action better than a concave directing edge, as it is moving in the same direction as the cutting edge relative to the line. However, in other embodiments other shapes may be used. The blade 160 or 216 can also be a razor blade, with two convex plastic edges 170, 236, or 244, on either side of the cutting edge, overhanging the blade 160 or 216 and compressing the line onto the cutting edge, producing a better, quicker and cleaner cut. The knife 100 or 200 is made of two halves of plastic, sandwiching the blade 160 or 216, respectively.

In an embodiment, the knife 100 or 200 have overall dimensions are (84 mm+/−9 mm)×(36 mm+/−4 mm)×(8 mm+/−1 mm) or (3.3+/−0.33 inches)×(1.417+/−0.15 inches)×(0.32+/−0.03 inches) inches. In general, any dimension specified in this specification may be altered by increasing or decreasing the value of that dimension within a range of at least 10% of the value of the dimension or may be increased in size within a range of 100% of the dimension, although the dimensions of other components may need to be scaled proportionately also. Other sizes and dimension may be used instead of those mentioned explicitly in the specification. The blade 160 or 216 is replaceable, which in an embodiment may be the only disposable part of the knife 100 or 200. In an embodiment, blade 160 is 57.15 mm+/−6 mm long×18.5 mm+/−2 mm wide×0.38 mm+/−0.04 mm thick (or 2.25+/−0.3 inches long, 0.73+/−0.07 inches wide, 0.015+/−0.002 inches thick). In an embodiment, the blade 160 or 216 sits in the middle of the housing, with a screw 142 or 212 going through the middle of the blade 160 or 216 to add to the security of the blade 160 or 216's position. In an embodiment the thickness or half thickness of the overhang 180, 238, or 246 is 2.5 mm+/−0.3 mm (0.098 inches+/−0.09 inches), as can be seen in FIG. 2F. In an embodiment, the cutting edge 162, 226 or 228 of the blade is 5.5+/−0.6 mm (0.216+/−0.03 inches) away from the slot 130, 230, and/or 235 along its length. In an embodiment, at the furthest point on the arm facing the blade, the distance between the cutting edge 226 or 238 of the blade and the directing edge 236, or 244, which is distance 240 or 248, is 4.575 mm+/−0.4 mm on either side. In another embodiment the protection to the fingers is enhanced by the length of the arm having the directing edge 236 or 244, which may be 5 mm+/−0.5 mm (0.197 inches+/−0.02 inches). This protection is afforded by the length of the directing edge, which is 5 mm+/−0.5 mm. In another embodiment, referring to the surface of the overhang that faces the viewer in FIG. 1C as the top of the overhang, the distance from the flat face of the blade (not the cutting edge) in a direction perpendicular (which is the direction pointing out of the page in FIG. 1C) from the surface of the flat face of the blade (or perpendicular to the relatively flat face of the entire knife assembly) to the top of the overhang is 2.6 mm, 3 mm, 3-4 mm, or 2.6 to 4 mm (the flat face of the blade is parallel to the plane of the blade). In an embodiment the distance from the apex of groove 135 or the apex of the corresponding groove of knife 200 to the cutting edge of the blade closest to groove 135 (where the distance is measured in a direction perpendicular to the cutting edge in the plane of the blade, which would be in a horizontal direction in FIG. 1C) is 3.5 mm, 5 mm, 3.5 mm to 5 mm, or 3 mm to 6 mm.

In an embodiment, the distance between the cutting edge of the blade and the directing edge of the slot is relatively small on either side. In an embodiment, the two halves are held together by 316ss grade stainless steel screws. In an embodiment, the blade is exposed along ¾ of the blade's length for the purpose of cutting line, but the exposed area may be minimized to protect the user's fingers. In another embodiment, the entire length of the cutting edges is exposed for cutting. In an embodiment, the opening to the 216 is about 17 mm+/−2 mm (or 0.47+/−0.05 inches). Since the blade 160 or 216 is a partially covered blade, it minimizes the danger of having an open sided blade being mishandled. The knife 100 or 200 provides a partially sealed blade and it minimizes the danger of having an open sided blade being swung in a dangerous manner or being mishandled.

In an embodiment, knife 100 or 200 is made of two halves of plastic, sandwiching together a blade 160 or 216. In an embodiment, the blade 160 is not placed in the center of the knife, but is located just 2 mm+/−0.2 mm (0.078 inches+/−0.008 inches) off from the edge of the knife 100. In an embodiment, the blade 216 is placed in the center of the knife 200. Having blade 160 or 216 covered by the overhang portion allows the cutting edge 162 of the blade to be further away from the fingers of the user. In an embodiment, the cutting edge may be located 15 mm+/−2 mm (0.59+/−0.06 inches) from the edge of the knife 100 that is furthest from the handle. The sides of the slot 130, 218, or 224 leading to the blade 160 or 216 are relatively short. Even though the knife 100 only has one cutting side, blade 160 has an advantage for technical divers that wears dry suits (not all technical divers wear wet suits, but there is a benefit for those that do) or for anyone else that wears a dry suit (technical diving describe a type of advanced diving which uses sophisticated air management techniques to minimize the possibility of decompression sickness). In an embodiment, blade 160 has just one exposed cutting edge. In an embodiment, the exposed cutting edge is the only cutting edge. In an alternative embodiment, there may be a second cutting edge buried with the casing of knife 100, which is not exposed. When the exposed edge becomes dull, the casing may be opened up, blade 160 may be flipped around, and the casing closed, so that the dull edge is now buried in the case and not exposed while the previously unused edge is not exposed. By pushing the blade 160 further away from the center, allowing just one side for cutting, so that the exposed portion of the blade is further away from the edge of the knife 100 minimizes the risk of accidentally cutting the dry suit (the center refers to the midpoint with respect to the length of knife 100). In contrast, keeping blade 216 centered, keeps each cutting blade further from the edge, the knife 100 minimizes the risk of accidentally cutting the dry suit (the center refers to the midpoint with respect to the width of knife 100). Blade 160 has an advantage for technical divers that wear use dry suits (as explained above not all technical divers wear wet suits, but there is a benefit for those that do) or anyone else that wears a dry suite. Technical divers also work in zero visibility conditions and a one sided blade minimizes the possibility of accidentally cutting a life saving guide line or the dry suit. Also, in an emergency situation all divers of all grades, stand a much higher chance of dislodging their mask, and there is generally no visibility without the mask. Consequently, all divers, not just technical divers, have a chance of being in zero visibility conditions. In an embodiment, the knife 100 has the possibility of cutting line up to 14 mm thick (0.55+/−0.006 inches), recognizing the fact that technical divers have a need to cut thick line associated with underwater scooters, kelp, and webbing. Thicker lines may be cut by making the knife larger increasing the size of the opening and the distance of the directing edge to the blade.

The blade 160 or 216 can be a carpet blade (for example) and is replaceable. The blade 160 or 216 is replaceable, and this is the only disposable part of the tool. The carpet blade sits to the side, with a screw going through the tool to add to the security of the blade's position. In an embodiment, the distance of the overhang is 3 mm+/−0.3 mm (0.118+/−0.02 inches). The opening to slot 130, 218 or 224 is 10 mm+/−1 mm (0.394+/−0.04 inches), away from the cutting edge of the blade. In an embodiment, the distance between the cutting edge 162, 226, or 228 of the blade and the directing edge 170, 236, or 244 is 3.25mm+/−0.3 mm, respectively.

In an embodiment, in which blade 160 or 216 is replaceable, blade 160 or 216 may be the only disposable part of the knife 100 or 200. In another embodiment other portions of the knife are also replaceable. In an alternative embodiment, blade 160 or 216 is not replaceable, and once blade 160 or 216 wears out, the knife 100 may be disposed of. The blade 160 or 216 is situated to the side of the knife 100. A screw 142 extends through the knife 100 to add to the security of the blade 160 or 216's position. The two halves and blade 160 or 216 are held together by a 316ss grade stainless steel screw 142.

In another embodiment, a handle slot 120 or 204 is provided and has a 5 mm+/−0.5 mm (0.197+/0.02 inches) wide opening 120 or 204 at the bottom that is about 26 mm long. In another embodiment the opening is about 26 mm×17 mm. The handle slot 120 is designed to have a piece of 25.4mm+/−2.3 (1 inch+/−0.1)×177.8 mm+/−18 mm (7 inch+/−0.7 inches) polypropylene webbing, folded around the handle slot 120 or 204 and sewn together, with a two inch piece of Velcro. The knife 100 or 200 is designed to fit into a folded and sewn piece of 2 inch wide Nylon, polypropylene, polyester webbing or other such materials (e.g., leather, canvas, etc.) of lengths 190+/−19 mm (7.48+/−0.8 inches), 210 mm+/−21 mm (8.27+/−0.9 inches), and 225 mm+/−23 mm (8.858+/−0.9 inches), depending on which size of pouch may be used. The pouch for the diver's knife is one piece of webbing, and is placed on the wrist around the user's wrist. It can also fit around any diving harness, or professional harness made of 2 inch thick webbing. The pouch is pushed into the arm, and not away from the arm, reducing the amount of danger from entanglement. Also, the webbing folds around the computer watch strap with ease, but leaves the integrity of the pouch in place. In an embodiment slot 120 or 204 is shaped so that it can act as a bottle opener.

Method of Use

Figure 3:
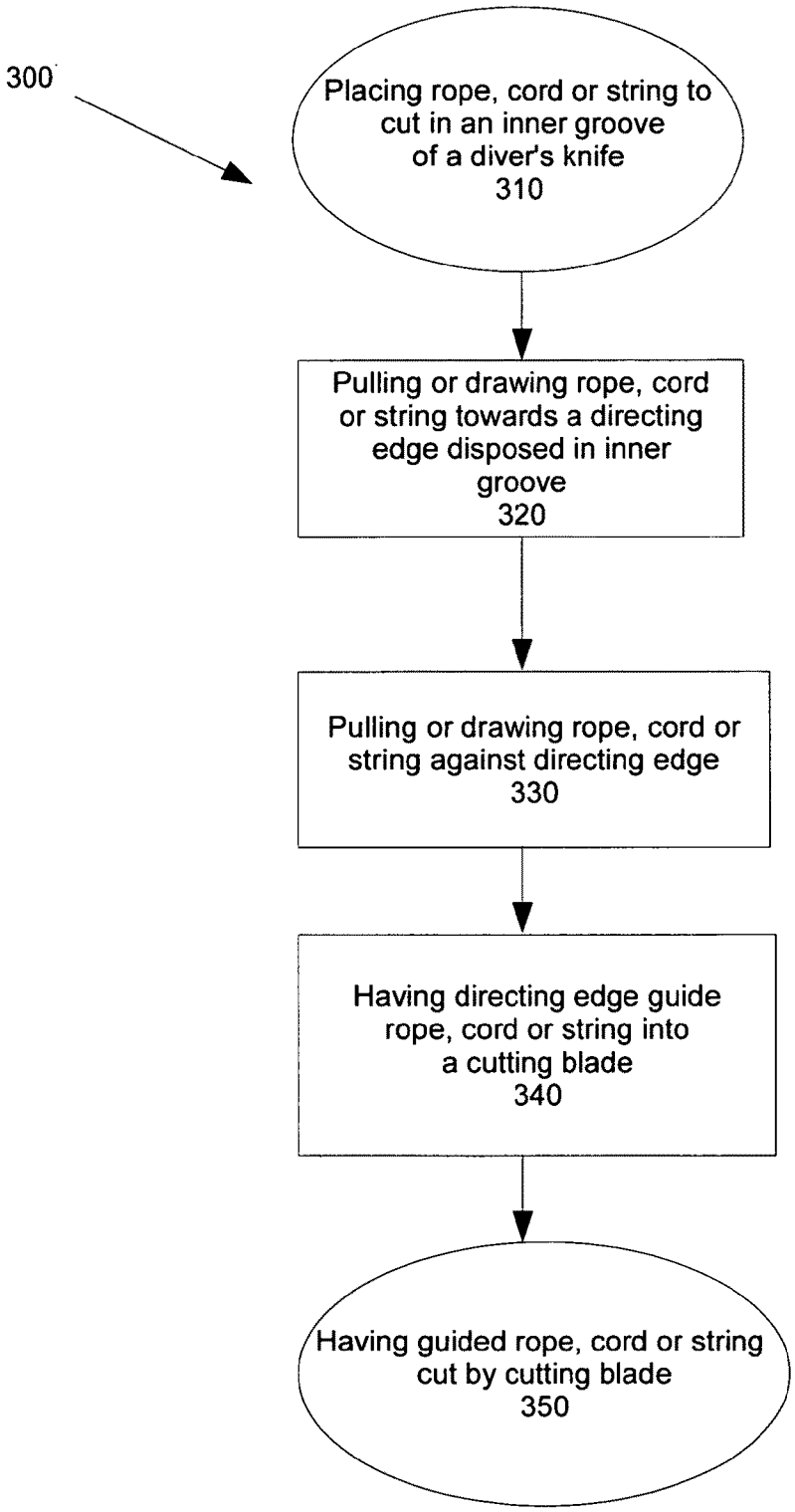
FIG. 3 shows a flow chart of an embodiment of a method for using a diver's knife to cut a line.

FIG. 3 shows a flow chart of an embodiment of a method 300 for using a diver's knife to cut a rope, cord or string. In step 310, a user places the line in the opening of the knife in slot 130 (formed by the arm and the body of the knife). The method 300 utilizes a knife having an arm with a directing edge with a directing edge, which may have a convex shape. In one embodiment, cutting blade is single-sided with one arm and a directing edge on one side. In another embodiment, the cutting blade is double-sided with two arms having directing edges for each blade. In step 320, the user pulls the knife in a direction such that the cord position changes relative to the knife. The movement of the knife causes the cord to slide within the slot in a direction parallel to the blade and in a direction such that the line's position (relative to the knife) becomes closer to the point where the arm meets the body of the knife. In step 330, the directing edge directs the line into the blade of the knife. Optionally, to the extent that the blade does not immediately begin to cut into the line, the line is pinched by the groove in the directing edge. In step 340, as the blade is pushed into the line, the line is severed.

In an embodiment, each of the steps of method 300 is a distinct step. In another embodiment, although depicted as distinct steps in FIG. 3, steps 310-340 may not be distinct steps. In other embodiments, method 300 may not have all of the above steps and/or may have other steps in addition to or instead of those listed above. The steps of method 300 may be performed in another order. Subsets of the steps listed above as part of method 300 may be used to form their own method.

Method of Making

Figure 4:
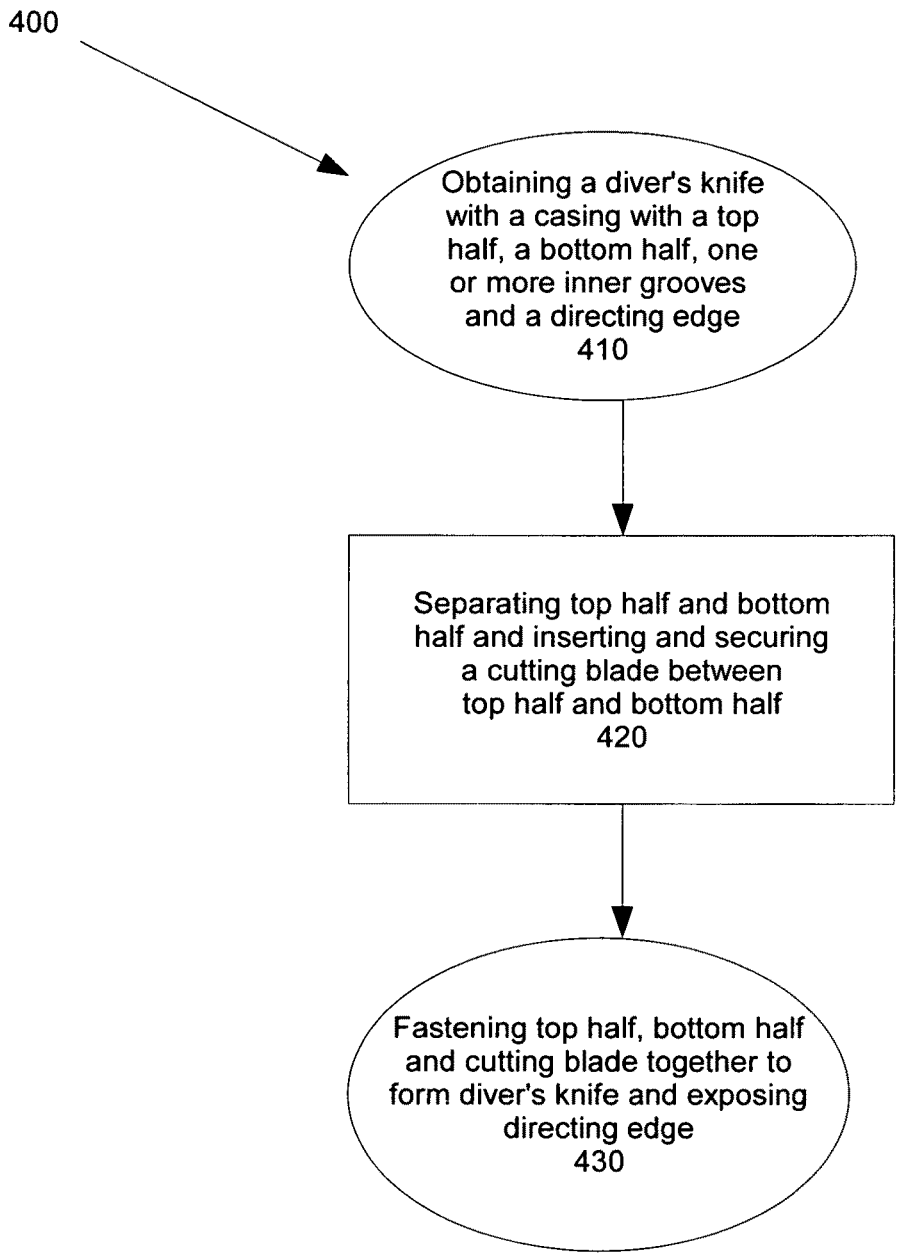
FIG. 4 shows a flow chart of an embodiment of a method for constructing the knife.

FIG. 4 shows a flow chart of an embodiment of a method 400 for constructing a diver's knife. In step 402, the top half of the casing is molded or otherwise formed. In step 404, the bottom half of the cover is molded or otherwise formed. Steps 402 and 404 may include molding the arm having the directing edge, molding a protrusion for holding the blade in one of the top or bottom halves of the casing and a well or another protrusion of the other of the top and bottom halves of the casing that mates with the protrusion on the first of the top and bottom halves of the casing. Steps 402 and 404 may also include forming one or more sockets through fasteners, such as screws or bolts may be placed for fastening the top and bottom halves of the casing together. One or more of the sockets may have a noncircular shape (e.g., hexagonal) for mating with a noncircular shape of a portion of the fastener (e.g., the head of the screw or bolt or with the nut). Steps 402 and 404 may also include forming a well for receiving the blade in one or both of the top and bottom halves of the casing. Steps 402 and 404 may further include forming a handle with a slot for grabbing and/or pulling with a hand. In step 406, the blade is formed by extrusion, casting, or molding and then sharpening one or more of the edges, for example. Forming the blade may include forming one or more apertures within the blade through which the protrusion of the top and/or bottom halves of the casing may protrude. In step 408, the fasteners (e.g., the bolt and nut) are formed by casting or molding, for example. In step 410 the blade is placed onto one of the top half and bottom half of the casing, which may include placing the blade on one or more protrusions and/or in a well to hold the blade from moving sideways. In step 412, the top and bottom halves of the casing are joined together such that the protrusion from one half mates with a well or protrusion on the other half sandwiching the blade between the two halves of the casing in the body of the casing leaving one cutting edge or two cutting edges exposed facing the arm or arms of the casing of the knife. In step 414, the fasteners are placed into sockets in the casing and the top half and bottom half and cutting blade are fastened together to form the knife illustrated in FIGS. 1A, 1B, 1C, 2A, 2B, 2C, 2D, 2E for both the single-sided and double-sided embodiments. Optionally, placing the fasteners into the sockets may cause the fastener to pass through an aperture in the blade.

In an embodiment, each of the steps of method 400 is a distinct step. In another embodiment, although depicted as distinct steps in FIG. 4, steps 402-414 may not be distinct steps. In other embodiments, method 400 may not have all of the above steps and/or may have other steps in addition to or instead of those listed above. The steps of method 400 may be performed in another order. Subsets of the steps listed above as part of method 400 may be used to form their own method.

Figure 5:
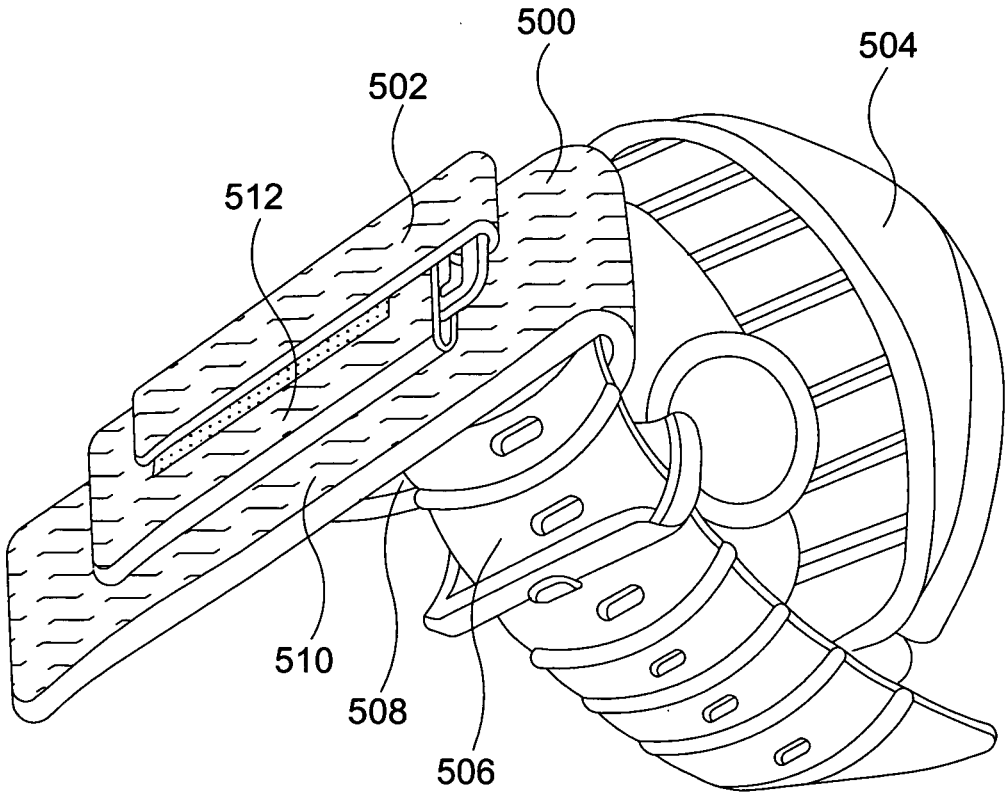
FIG. 5 shows a side view of an embodiment of a sheath for the knife.

FIG. 5 shows a side view of an embodiment of sheath 500. The components of FIG. 5 are, sheath 500, knife strap 502, watch 504, band 506, loop 508, sheath body 510 and sheath enclosure 512. The components that make up sheath 500 are, sheath flap 502, loop 508 and sheath body 510. In other embodiments sheath 500 may have other components in addition to or instead of those shown in FIG. 5.

Sheath 500 holds the knife. In an embodiment, sheath 500 is made of a flexible, abrasion resistant material such as nylon. In other embodiments, sheath 500 can be constructed of other materials, such as leather or neoprene.

Knife strap 502 wrap through the slot at the end of the knife and attaches to the pocket. Watch 504 is a diver's watch, but any band or belt or device including a band or belt may be substituted for watch 504. In an embodiment, sheath 500 is affixed to watch 504 by passing band 506 through loop 508. Band 506 can be any band for a wrist, arm, leg or foot, a diver's watch for example. Loop 508 is created by sheath body 510 being folded back and attached to itself.

In an embodiment, sheath enclosure 512 serves as a place to store either knife 100. Sheath enclosure 512 is affixed to sheath body 510 so that sheath enclosure 512's opening is oriented in the direction of loop 508. In other embodiments, sheath enclosure 512 can have various orientations. Knife 100 is secured within sheath enclosure 512 by knife strap 502, which is attached to the handle of knife 100 and secured to sheath enclosure 512 by a hook and loop material, such as Velcro® or another hook and loop material. When attached to enclosure 512, via the hook and loop material, knife strap 502 prevents the knife from slipping out of enclosure 512. In an embodiment, sheath 500 can be used to store knife 100 or 200 or any type of diving knife.

Figure 6:
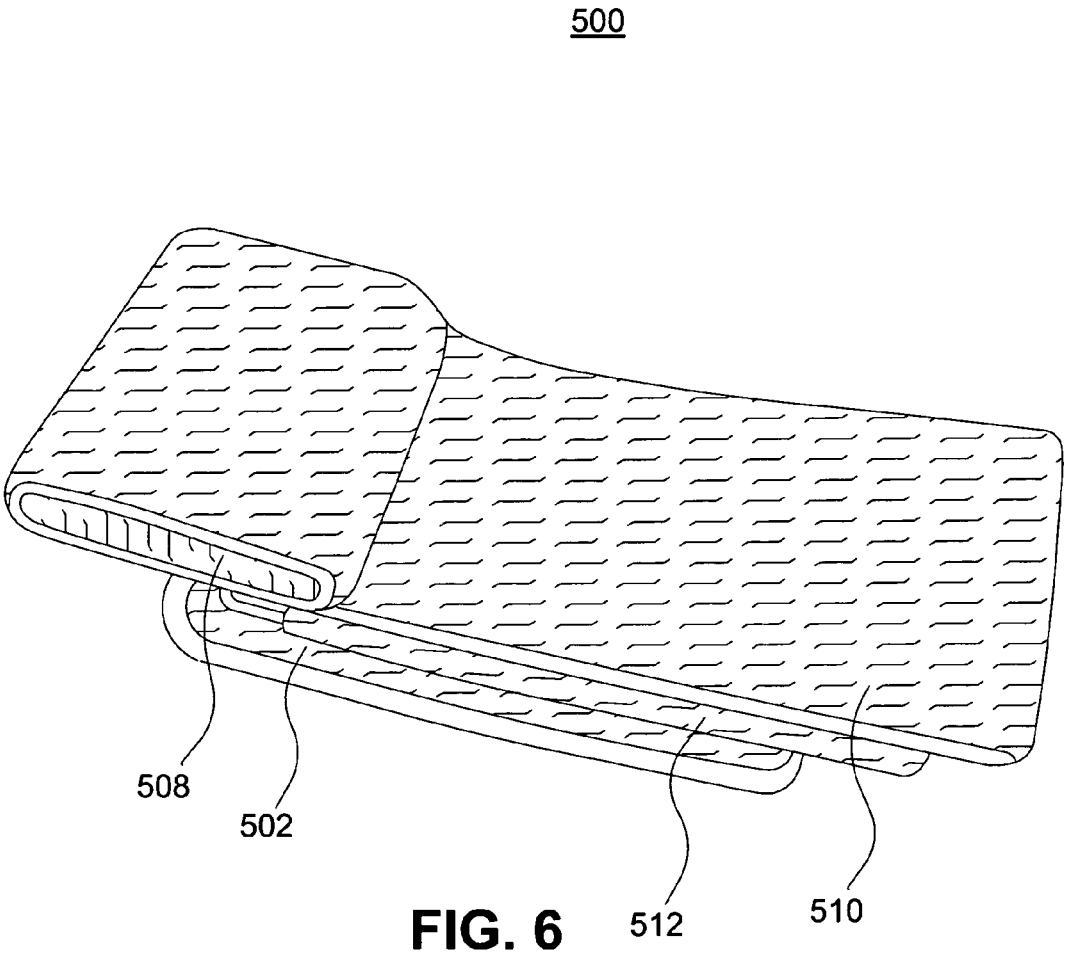
FIG. 6 shows a back view of an embodiment of a sheath for the knife.

FIG. 6 shows a back view of an embodiment of a sheath. The components of FIG. 6 are sheath 500, knife strap 502, loop 508, sheath body 510, and sheath enclosure 512, which were discussed above in conjunction with FIG. 5. In other embodiments, sheath 500 may have other components in addition to or instead of those shown in FIGS. 5 and 6. Loop 508 may be formed by folding back the piece of material that makes up the back portion of sheath enclosure 512.

Figure 7:
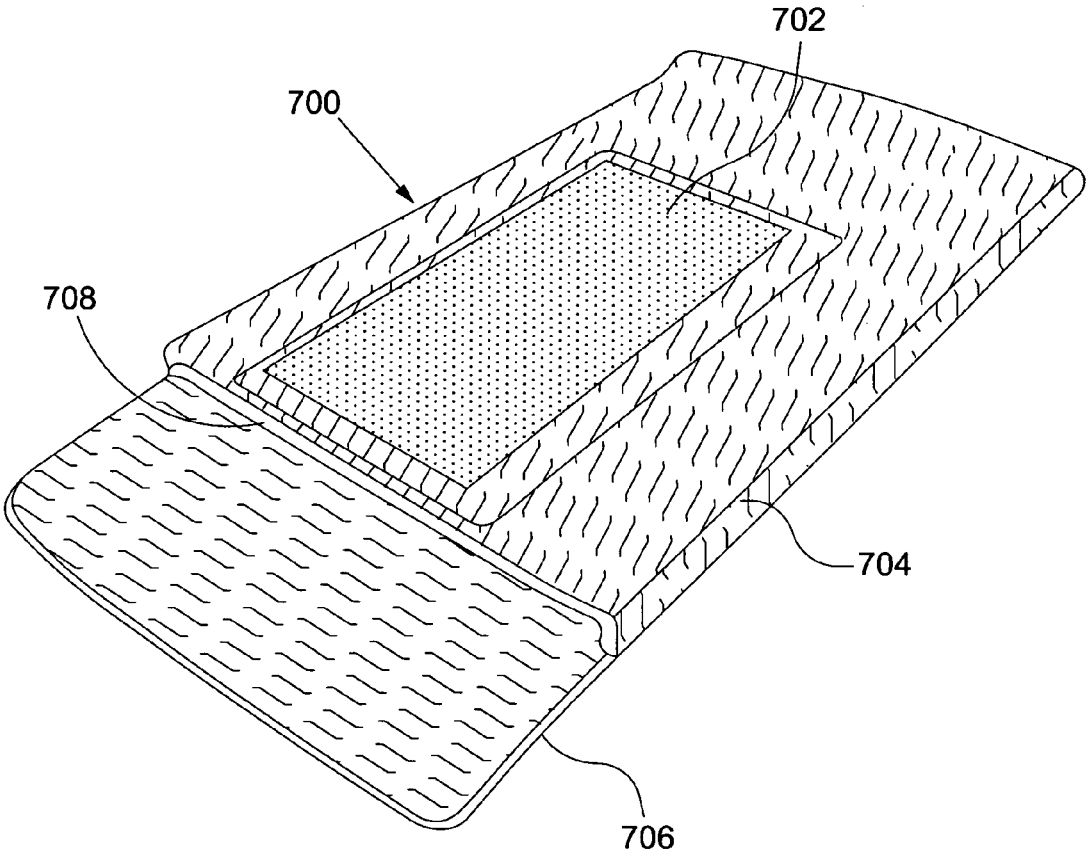
FIG. 7 shows a front view of a representation of an embodiment of sheath for the knife.

FIG. 7 shows a front view of a representation of an embodiment of sheath 700, which includes fastener 702, front piece of material 704, back piece of material 706, and pocket 708. In other embodiments, sheath 700 may have other components in addition to or instead of those shown in FIG. 7.

Sheath 700 is another embodiment of sheath that may be used with knife 100 or 200. Fastener 702 may be a hook and loop material, such as Velcro®, or another type of fastener. For example, fastener 702 may be a button or snap. Fastener 702 is attached to the front of pocket 700. For example, fastener 702 may be adhered, glued, heat bonded, or sewn to the front of pocket 700. In this specification when ever two pieces of material are attached, those piece of material may be adhered, glued, heat bonded, or sewn to one another. Front piece of material 704 from the front of pocket 700. Front piece of material 704 has fastener 702 adhered to an outer surface of front piece of material 704. Back piece of material 706 forms the back of the sheath 700. In an embodiment, front piece of material 704 and back piece of material 706 have the same width, but back piece of material 706 is longer than front piece of material 704. Front piece of material 704 and back piece of material 706 are adhered together along the two of the longer edges and one of the shorter edges of front piece of material 704 and back piece of material 706 to form a pocket. Pocket 708 is formed by joining front piece of material 704 and back piece of material 706 along the two of the longer edges and one of the shorter edge.

Figure 8:
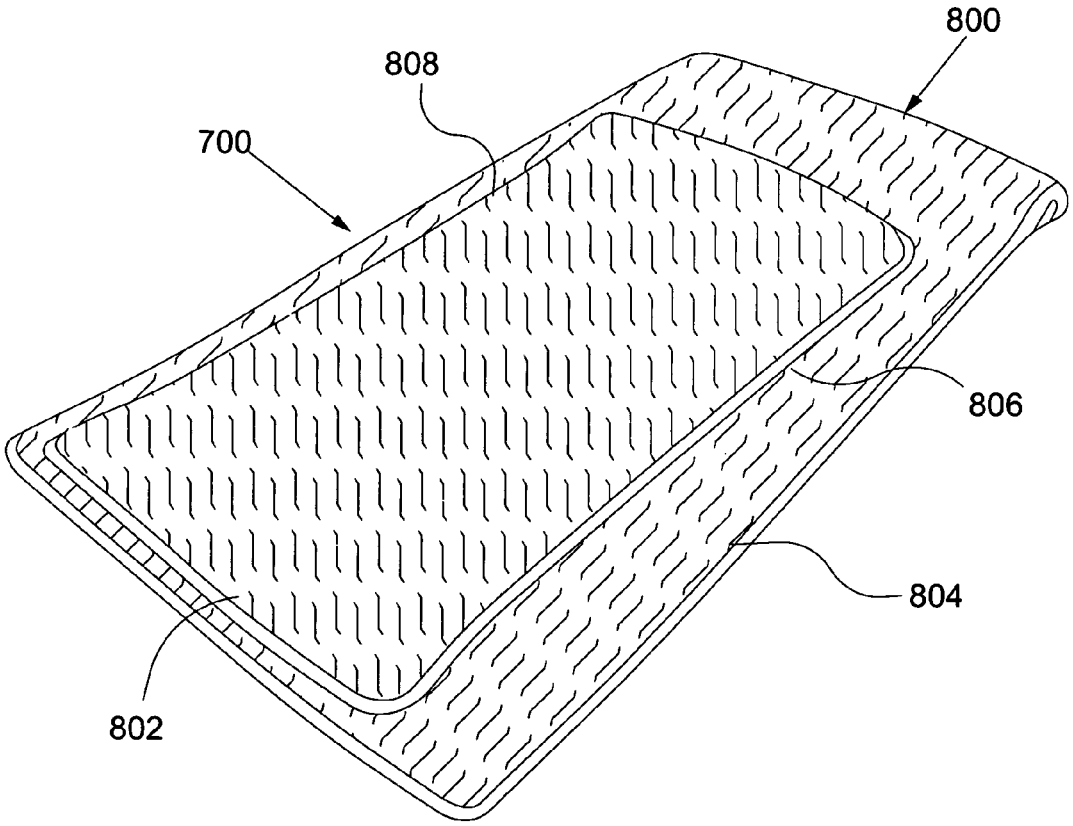
FIG. 8 shows the back side of a representation of an embodiment of a sheath for the knife.

FIG. 8 shows the back side 800 of a representation of an embodiment of sheath 700, which includes loop material 802, back 804, first loop opening 806, and second loop opening 808. In other embodiments, back side 800 may have other components in addition to or instead of those shown in FIG. 7.

Back side 800 of is an embodiment of the back side sheath 700. Loop material 802 is attached to the backside of sheath 700 to form a loop. In contrast, loop of sheath 500 is formed by folding the back a piece of material of sheath 500. Back 804 may be the rear side of back piece of material 706. First loop opening 806 and second loop opening 808 are the openings of the loop formed by attaching loop material 802 to back 804.

Figure 9:
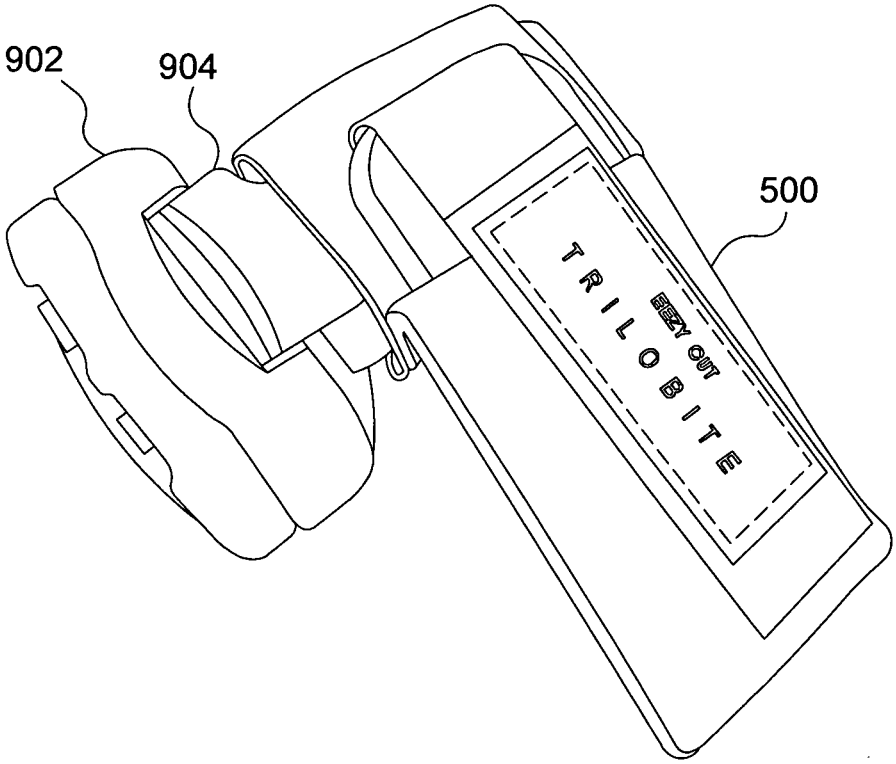
FIG. 9 shows an embodiment of the sheath of FIG. 5 on a diver's watch having a band.

FIG. 9 shows sheath 500 on a diver's watch 902 having band 904. Band 904 is placed through loop 508. In other embodiments, the equivalent view to that shown in FIG. 9 may have other features in addition to or instead of those shown in FIG. 9.

Figure 10:
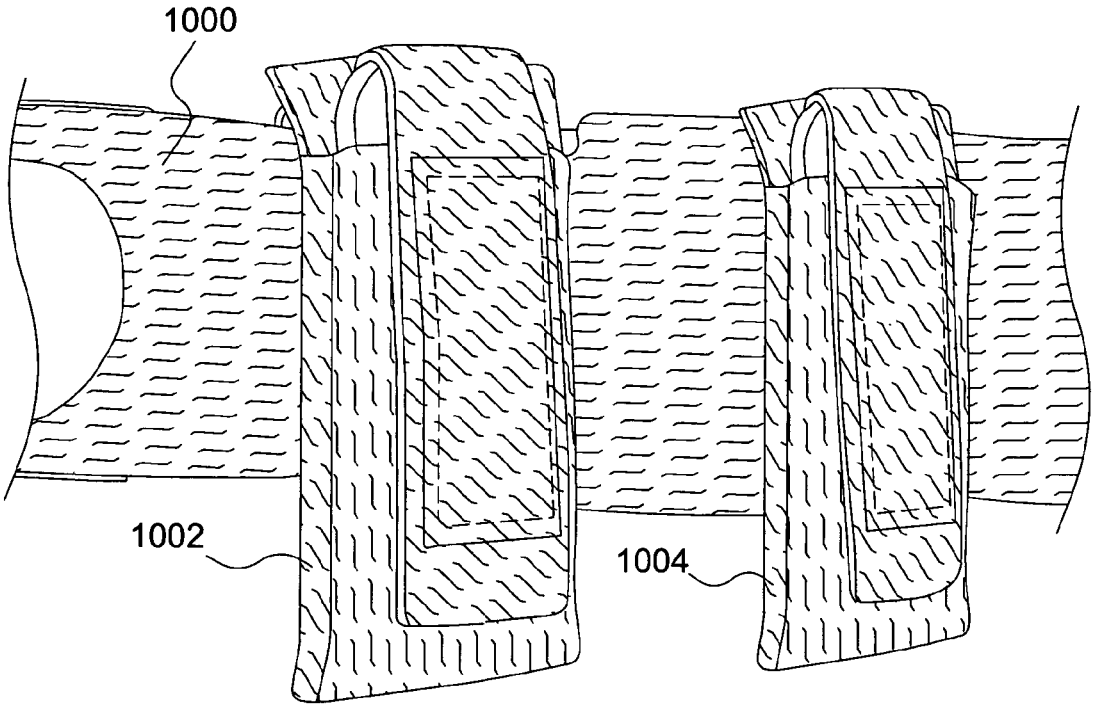
FIG. 10 shows a utility belt holding an embodiment of a sheath for the knife of FIG. 1 or the knife of FIG. 2.

FIG. 10 shows a utility belt holding sheaths for knife 100 or 200, having utility belt 1002, sheath 1004, and sheath 1006. In other embodiments, the equivalent view to that shown in FIG. 10 may have other features in addition to or instead of those shown in FIG. 10.

Sheaths 1004 and 1006 may be embodiment of sheath 700. Utility belt 1002 slides through the loops that correspond to loop of sheath 700.

Figure 11:
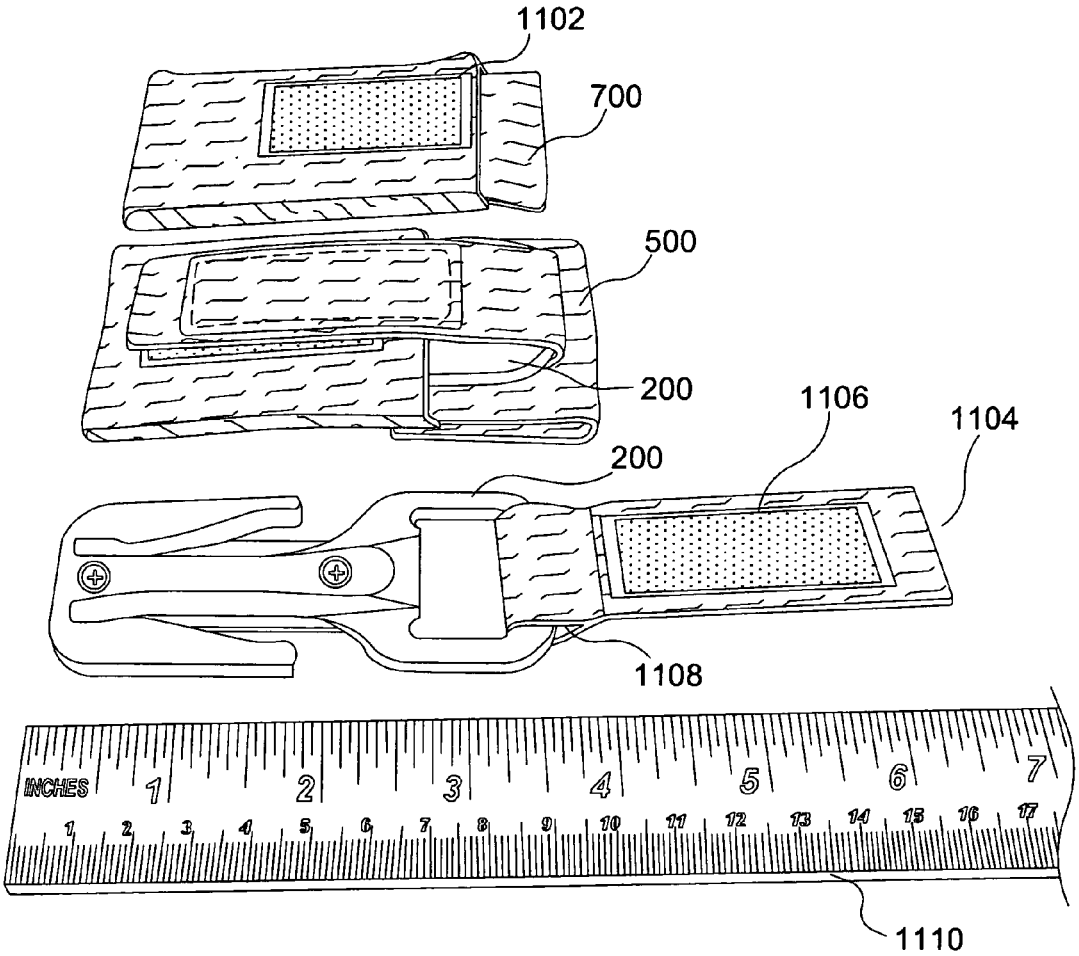
FIG. 11 shows the relative sizes of an embodiment of the sheaths of FIG. 5 and an embodiment of the sheath of FIG. 7.

FIG. 11 shows the relative sizes of sheaths 500 and 700. FIG. 11 includes knives 200, sheath 500, sheath 700, fastener 1102, strap 1104, fastener 1106, loop 1108, and ruler 1110. In other embodiments, the equivalent view to that shown in FIG. 11 may have other features in addition to or instead of those shown in FIG. 11.

Knives 200, sheath 500, sheath 700 were discussed in conjunction with FIGS. 2, 5, and 7, respectively, for example. Fastener 1102 may be an embodiment of fastener 702, which was discussed in conjunction with FIG. 7. Strap 1104 may be an embodiment of strap 502, which was discussed in conjunction with FIG. 5, for example. Fastener 1106 complements fastener 1102, such one engages the other to fasten. For example, one of fastener 1102 and 1106 may have the hooks and the other may have loops, of the hook and loop material. As some other examples, one of fastener 1102 and 1106 may be button and the other the button hole, or one of fastener 1102 and 1106 may be male snap and the other the female snap. Loop 1108 holds strap 1104 to knife 200 (or knife 100). Loop 1108 may be formed by folding over one edge of strap 1104 and attaching that edge to a lower portion of strap 1104. Ruler 1110 is provided to show the size of the embodiment of knives 200, sheaths 500 and 700, and strap 1104 of FIG. 11. The image is foreshortened, which must be taken into account when using ruler 1110 to measure other items in FIG. 11.

Alternatives and Extensions

In an embodiment, aperture 166 or 231 is ovular in shape formed by two semicircular endings connected by straight edges. In other embodiment, aperture 166 or 231 has other shapes and the post or posts that hold aperture 166 or 231 in place may have complementary shapes or other shapes that hold aperture 166 or 231 in place. In another embodiment, aperture 166 or 231 is replaced with two or more smaller apertures, through which two or more posts may protrude holding blade 160 or 216 in a fixed position.

Blade 160 or 216 may be replaced with any blade and cover 150 may be replaced with another cover that holds the blade in place and includes an overhang with an edge that pushes the line or rope in the cutting edge. For example, an enclosure may be made for encasing an ordinary knife inside a structure that only allows a portion of the cutting edge (one or both sides) of the blade to be exposed and opposite the exposed portion of blade there may be an overhang with a convex edge for pushing the rope or line into the blade. The exposed portion of the blade may be straight. Screws 142 or 212 and hex nuts 144 or 214 may be replaced, or augmented, with other fasteners, such as rivets, snaps, clasps, buckles, nails, and/or an adhesive. For example, rather than screws 142 or 144 screwing into a bolt, screws 142 or 144 may screw into a socket in casing 110 or 202. Instead of casing 110 or 202 having two halves that are fastened together, casing 110 or 202 may have more components and/or may be divided into different components. For example, casing 110 or 202 may be one integral piece of material, or may have two portions on both sides of blade 160 or 216 instead of on the top and bottom of blade 160 or 216.

In another embodiment, the exposed portion of the blade is not straight and/or may be curved. In another embodiment, the overhang has a straight edge, and the blade has a convex edge. Although blade 160 or 216 is expected to work better if it is not serrated, in an alternative embodiment, blade 160 or 216 is serrated.

Each embodiment disclosed herein may be used or otherwise combined with any of the other embodiments disclosed. Any element of any embodiment may be used in any embodiment. Although the invention has been described with reference to specific embodiments, it will be understood by those skilled in the art that various changes may be made and equivalents may be substituted for elements thereof without departing from the true spirit and scope of the invention. In addition, modifications may be made without departing from the essential teachings of the invention.

The invention claimed is:

1. A method comprising:

placing a knife, so that a line to be cut is located in an opening between a handle portion of a knife, which partially obstructs a slot, and a protective overhang of the knife, the opening leads to an area adjacent to the slot, the slot being formed by a first portion of a straight cutting edge of a blade of the knife and an interior edge of the protective overhang, the first portion of the cutting edge faces the protective overhang, and the cutting edge having a second portion that extends beyond the protective overhang facing the opening, the first portion of the cutting edge and the second portion of the cutting edge being two parts of the one continuous and straight cutting edge;

the placing of the knife includes initially placing the knife so that the second portion of the cutting edge faces the line and is exposed to the line prior to the line entering the slot formed by the first portion of the cutting edge and the protective overhang;

moving the knife so that the line moves into the slot;

the moving of the knife includes pulling the knife away from the line so that as a result of pulling the knife, the line moves, relative to the knife, away from the opening in a direction parallel to the straight cutting edge into the slot; and as the knife is pulled, the protective overhang guiding the line into the cutting blade.

2. The method according to claim 1, wherein the cutting edge is part of a handheld knife and the interior edge has a convex shape.

3. The method according to claim 1, the opening being a first opening and the cutting edge being a first cutting edge, the knife having a second opening that leads to a second cutting edge, the method further comprising determining whether to place the line into the first opening and cut the line with the first cutting edge or place the line into the second opening and cut the line with the second cutting edge.

4. A knife comprising:

at least two cutting blade portions each cutting blade portion having at least one cutting edge, a first cutting edge of the at least two cutting blade portions being parallel to and facing the opposite direction of a second cutting edge of the at least two cutting blade portions, the first cutting edge and the second cutting edge being separated by a body parallel to the first cutting edge and the second cutting edge, the body having a head side and a tail side;

a first protective overhang located opposite the first cutting edge, the first protective overhang having a first convex edge shaped to bulge inward toward the first cutting edge, the first cutting edge and the first protective overhang forming a first slot for directing a line into the first cutting edge;

a second protective overhang located opposite the second cutting edge, the second protective overhang having a second convex edge shaped to bulge inward toward the second cutting edge, the second cutting edge and the second protective overhang forming a second slot for directing a line into the second cutting edge, the first slot and the second slot facing away from the head side of the body, the first slot and the second slot are partially obstructed by a handle portion located opposite each of the first slot and second slot.

5. The knife according to claim 4, further comprising:

a casing including at least the overhang, and a portion for holding the blade body that is attached to the overhang.

6. The knife of claim 4, further comprising:

a casing including at least a top half, and a bottom half that is a separate piece removably attached to the top half;

the at least two cutting blades being sandwiched between the top half and bottom half leaving the cutting edges exposed.

7. The knife according to claim 6, wherein the casing has a noncircular socket;

the knife further comprising:

a fastener having a cylindrical body with a non-circular head, the non-circular head mates with the non-circular socket, the fastener secures the top half of the casing to the bottom half of the casing.

8. The knife according to claim 7, the knife further comprising:

a nut;

the noncircular socket being on one side of the casing and the nut being located on another side of the casing;

the blade having an aperture;

the fastener extending through the noncircular socket through the aperture, and attaching to the nut.

9. The knife according to claim 4, further comprising a protective film coating the at least one cutting edge.

10. The knife according to claim 4, wherein each protective overhang has a directed edge to guide the line to be cut to the at least one cutting edge.

11. The knife of claim 4, wherein the knife is symmetrical with respect to a center line between the first overhang and the second overhang.

12. The knife of claim 4, wherein the first convex edge covers a fourth of the first cutting edge, exposing three fourths of the first cutting edge for the purpose of cutting line; and wherein the second convex edge covers a fourth of the second cutting edge, exposing three fourths of the second cutting edge.

13. The knife of claim 4, wherein a portion of the first cutting edge that is exposed for cutting forms one side of the first slot, and the portion of the first cutting edge that is exposed for cutting is longer than any other side of the first slot.

14. The knife of claim 4, wherein the first cutting edge being straight, the first cutting edge forms a first side of the first slot, the first overhang forms a second side of the first slot, a first portion of the first cutting edge facing the first overhang, the first overhang facing the cutting edge, and a second portion of the cutting edge extending beyond the overhang.

15. A knife comprising:

a body, the body having a head side and a tail side;

a cutting blade having a cutting edge lon itudinally parallel to the body;

a protective overhang located opposite the cutting edge, the protective overhang having a convex edge bulging in a direction towards the cutting edge, the head side having a handle portion, the handle portion and the protective overhang forming an opening for directing a line into a slot, the slot being formed between the cutting edge and the protective overhang, the slot being partially obstructed by the handle portion, which is located opposite the slot, a mouth of the slot facing towards the tail side of the body, the protective overhang having a groove along the convex edge of the overhang, opposite the cutting blade, wherein the groove faces the cutting blade but is not in contact with the cutting blade, the groove having two walls and the having an apex that is parallel to the cutting blade, the two walls of the groove forming the convex edge of the protective overhang.

16. A knife comprising:

a body, the body having a head side and a tail side;

a cutting blade having a cutting edge longitudinally parallel to the body; and a protective overhang located opposite the cutting edge, the protective overhang having a convex edge bulging in a direction towards the cutting edge, the head side having a handle portion, the handle portion and the protective overhang forming an opening for directing a line into a slot, the slot being formed between the cutting edge and the protective overhang, the slot being partially obstructed by the handle portion, which is located opposite the slot, a mouth of the slot facing towards the tail side of the body, the protective overhang having a groove opposite the cutting blade, the groove facing the cutting blade, the groove having two walls and groove having an apex that is parallel to the cutting blade, the two walls of the groove forming the convex edge of the protective overhang; and the groove having a length, wherein at a portion of the groove that is closer to the tail, the apex is a flat wall, portions of the groove further from the tail having a narrower apex than portions of the groove closer to the tail, and the apex of the groove narrowing gradually along the length of the groove until the two walls of the groove come together and the groove forms a v-shape.

* * * * *